US011988392B2

(12) United States Patent
Johnson et al.

(10) Patent No.: US 11,988,392 B2
(45) Date of Patent: May 21, 2024

(54) REMOVABLE HEATING ELEMENT COVER FOR AN OVEN APPLIANCE AND METHODS OF DETECTING SAME

(71) Applicant: Haier US Appliance Solutions, Inc., Wilmington, DE (US)

(72) Inventors: Eric Scott Johnson, Louisville, KY (US); Hans Juergen Paller, Louisville, KY (US); Rebekah Leigh Tyler, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 419 days.

(21) Appl. No.: 17/324,439

(22) Filed: May 19, 2021

(65) Prior Publication Data

US 2022/0373189 A1 Nov. 24, 2022

(51) Int. Cl.

| | |
|---|---|
| ***F24C 7/00*** | (2006.01) |
| ***F24C 3/12*** | (2006.01) |
| ***F24C 7/08*** | (2006.01) |
| ***F24C 15/12*** | (2006.01) |
| ***F24C 15/32*** | (2006.01) |

(52) U.S. Cl.

CPC ..... *F24C 15/12* (2013.01); *F24C 3/128* (2013.01); *F24C 7/085* (2013.01); *F24C 15/322* (2013.01)

(58) Field of Classification Search

CPC ..... F24C 15/12; F24C 15/322; F24C 3/128; F24C 7/085

USPC ..... 126/41 R

See application file for complete search history.

(56) References Cited

U.S. PATENT DOCUMENTS

| | | | | |
|---|---|---|---|---|
| 1,425,501 | A * | 8/1922 | Maul | A47J 37/06 126/41 R |
| 5,485,780 | A * | 1/1996 | Koether | F24C 15/16 219/400 |
| 5,504,310 | A * | 4/1996 | Bae | H05B 6/642 219/757 |
| 7,066,169 | B2 | 6/2006 | Feldewerth | |
| 10,137,395 | B2 | 11/2018 | Yeon | |
| 2006/0096969 | A1 | 5/2006 | Kim | |
| 2012/0103966 | A1 * | 5/2012 | Gladhill | H05B 1/0263 219/391 |

(Continued)

FOREIGN PATENT DOCUMENTS

| | | |
|---|---|---|
| CN | 205885299 U | 1/2017 |
| CN | 210446760 U | 5/2020 |

(Continued)

*Primary Examiner* — Avinash A Savani

(74) *Attorney, Agent, or Firm* — Dority & Manning, P.A.

(57) ABSTRACT

An oven appliance includes a chamber, a fan assembly operable to cause air to flow in the chamber, and a first heating element adjacent to a bottom wall of the oven appliance. The oven appliance further includes a removable heating element cover configured for defining a duct in fluid communication with the fan assembly and the first heating element for directing airflow in the chamber to the fan assembly and across the first heating element to heat a food item. The oven appliance also includes a sensing device for detecting a presence of the heating element cover and a controller having a processor configured to receive an indication from the sensing device confirming whether the heating element cover is engaged with the sensing device and control operation of the oven appliance based on the indication.

17 Claims, 7 Drawing Sheets

(56) References Cited

U.S. PATENT DOCUMENTS

| | | | |
|---|---|---|---|
| 2016/0206139 | A1 | 7/2016 | Johnson |
| 2017/0089590 | A1 | 3/2017 | Bruin-Slot |

FOREIGN PATENT DOCUMENTS

| | | | |
|---|---|---|---|
| DE | 202005014349 | U1 | 11/2005 |
| KR | 102123063 | B1 | 6/2020 |
| WO | WO2018024557 | A1 | 2/2018 |

* cited by examiner

REMOVABLE HEATING ELEMENT COVER FOR AN OVEN APPLIANCE AND METHODS OF DETECTING SAME

FIELD OF THE INVENTION

The present disclosure relates generally to oven appliances, and more particularly, to a removable heating element cover used for certain cooking modes of the oven appliance that can be detected via a sensing device, such that the presence or absence of the cover dictates which mode the oven appliance can properly operate.

BACKGROUND OF THE INVENTION

Oven appliances generally include a cabinet with a cooking chamber positioned therein. The cooking chamber is configured for receipt of food articles for cooking. The oven appliance also includes a heating element for generating heat energy for cooking. The heating element can be, e.g., an electric resistance element or a gas burner. Certain oven appliances also include features for forcing movement of heated air within the cooking chamber. Such oven appliances are generally referred to as convection ovens.

In typical conventional ovens, heated air within the cooking chamber can be circulated with a fan when in a convection mode. The fan initiates a flow of heated air through a plurality of slots in a top wall of the oven's cabinet. The heated air exiting the slots in the top wall generally flows in a vertical direction. Such a configuration distributes heat energy evenly to food articles cooking on a top rack within the cooking chamber. However, food articles cooking on a lower rack disposed below the top rack generally do not receive the benefits of the flow of heated air because the top rack or items disposed on the top racks prevent the flow of heated air from continuing to the lower rack. Thus, when cooking food items on both the top and lower racks the benefits of convection oven may be limited to the food items disposed on the top rack.

In certain other convection ovens, the fan initiates a flow of heated air through a plurality of slots in a sidewall or a back wall of the oven's cabinet. The heated air exiting the slots in the sidewall or back wall generally flows in a horizontal direction. Such a configuration may distribute heat energy more evenly to both the top rack and the lower rack disposed below the top rack compared to the configuration described above. However, heated air flowing from a back to a front of a food article may cause the back of the food article to cook more quickly than the front of the food article. Similarly, heated air impacting edges of a food article may cause the edges to cook more quickly than a center of the food article.

Furthermore, it can be desirable to provide alternative methods for cooking foods with less oil, but that provide a similar crispy texture similar to that of deep-frying. However, for traditional convection ovens with horizontal airflow, the food items must be flipped over and/or rotated during the cooking process to provide even cooking. Additionally, it can be difficult to achieve a crispy texture in an oven without over cooking the item.

Accordingly, an oven appliance having a removable heating element cover used for certain cooking modes of the oven appliance that can be detected via a sensing device, such that the presence or absence of the cover dictates which mode the oven appliance can properly operate would be welcomed in the art.

BRIEF DESCRIPTION OF THE INVENTION

Aspects and advantages of the invention will be set forth in part in the following description, or may be obvious from the description, or may be learned through practice of the invention.

In one aspect, the present disclosure is directed to an oven appliance having a cabinet with a chamber positioned within the cabinet. The chamber is configured for receipt of a food item for cooking. The oven appliance also includes a door for providing selective access to the chamber and a plurality of walls including a top wall, a bottom wall, a back wall, a front wall, and opposing sidewalls defining the chamber. Further, the oven appliance includes a fan assembly operable to cause air to flow in the chamber. Moreover, the oven appliance includes a first heating element arranged adjacent to the bottom wall. In addition, the oven appliance includes a removable heating element cover configured for defining a duct in fluid communication with the fan assembly and the first heating element for directing airflow in the chamber to the fan assembly and across the first heating element to heat the food item. The oven appliance also includes a sensing device for detecting a presence of the removable heating element cover within the chamber and a controller communicatively coupled to the sensing device. The controller includes at least one processor configured to perform a plurality of operations, including but not limited to receiving an indication from the sensing device confirming whether the removable heating element cover is engaged with the sensing device and controlling operation of the oven appliance based on the indication.

In another aspect, the present disclosure is directed to a method for operating an oven appliance. The method includes providing a fan assembly adjacent to a back wall of the oven appliance. The method also includes providing a first heating element adjacent to a bottom wall of the oven appliance. Further, the method includes providing a sensing device within a chamber of the oven appliance for detecting a presence of a removable heating element cover within the chamber. The removable heating element cover is configured for defining a duct in fluid communication with the fan assembly and the first heating element for directing airflow in the chamber to the fan assembly and across the first heating element to heat a food item in the chamber. Moreover, the method includes receiving an indication from the sensing device confirming whether the removable heating element cover is engaged with the sensing device. Thus, the method includes controlling operation of the oven appliance based on the indication.

These and other features, aspects and advantages of the present invention will become better understood with reference to the following description and appended claims. The accompanying drawings, which are incorporated in and constitute a part of this specification, illustrate exemplary embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
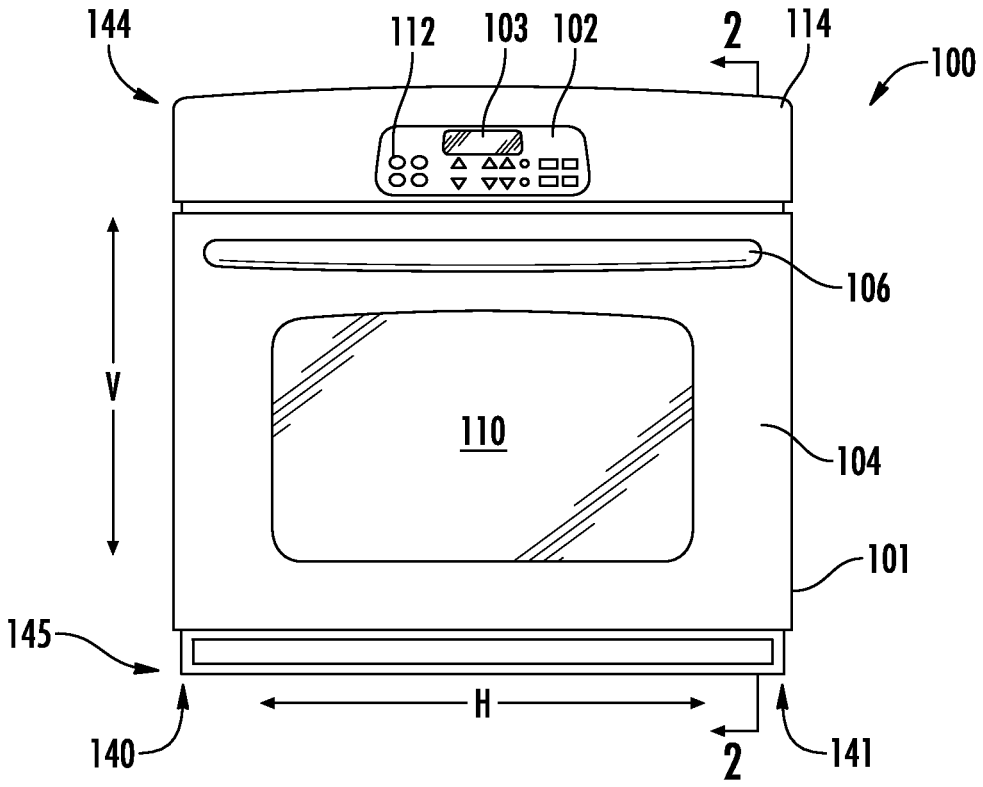
FIG. 1 provides a front view of an oven appliance according to an exemplary embodiment of the present invention.

Reference now will be made in detail to exemplary embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
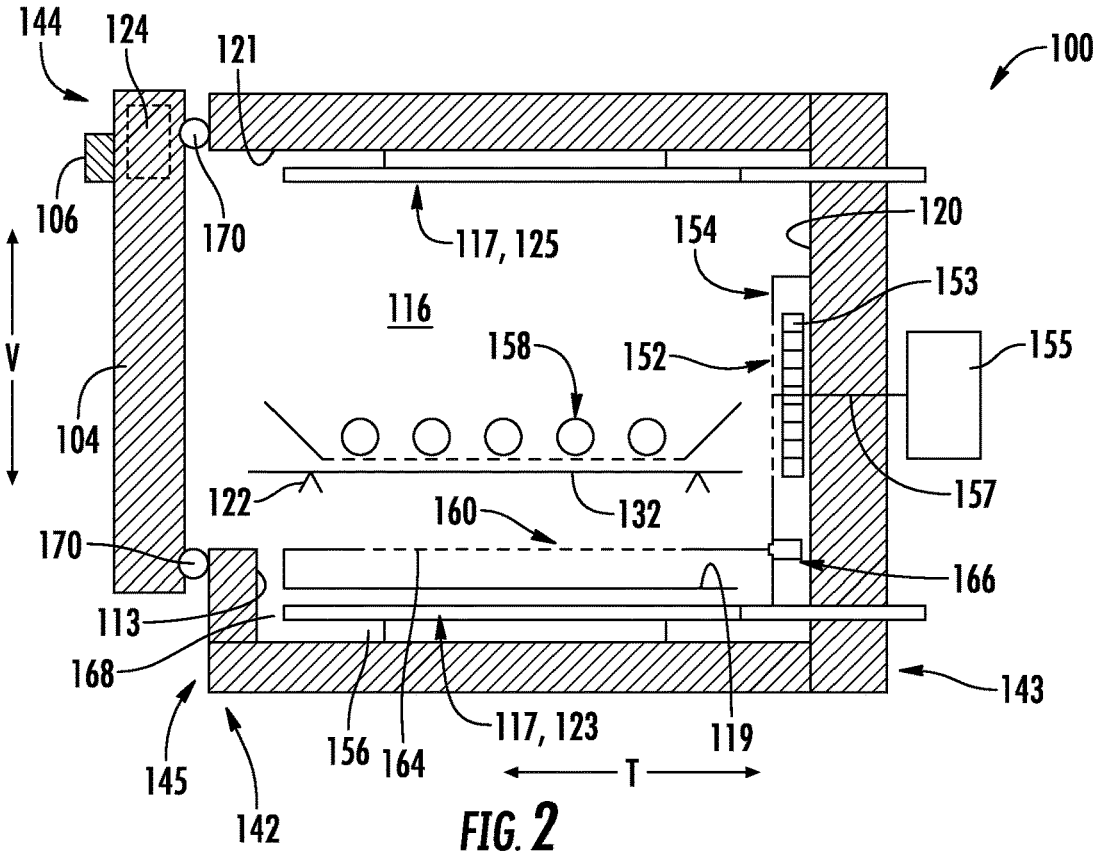
FIG. 2 provides a cross-sectional view of the oven appliance taken along the 2-2 axis of FIG. 1.
Figure 3:
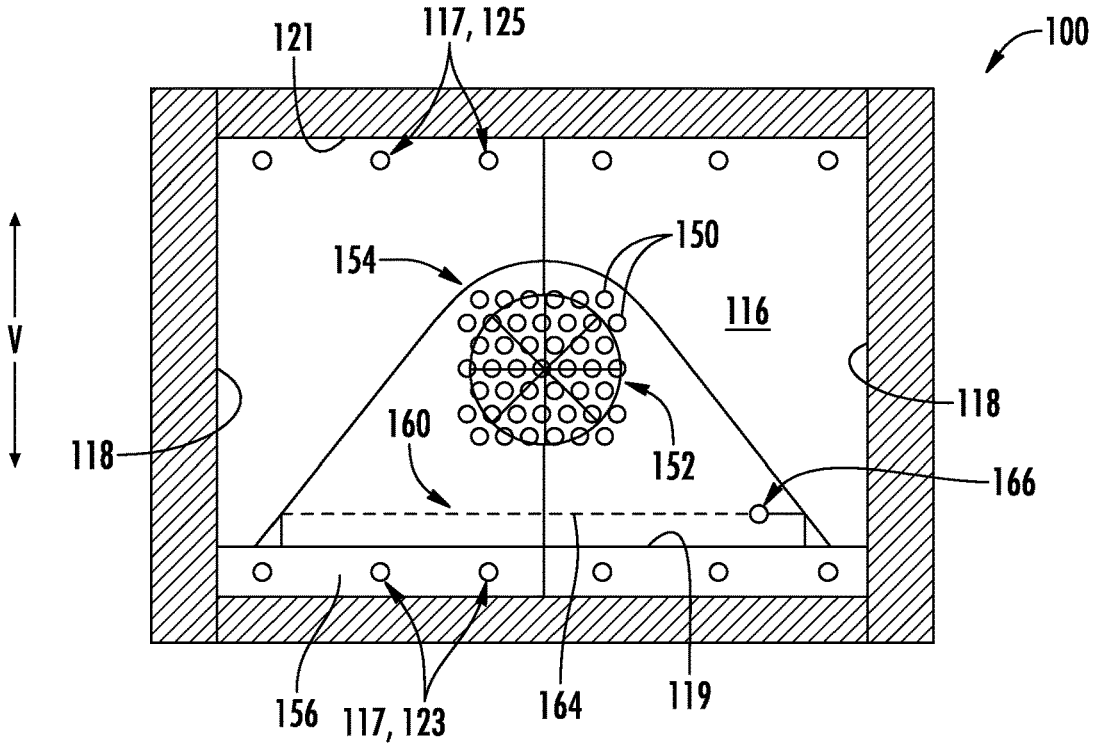
FIG. 3 provides a front, cross-sectional view of the oven appliance of FIG. 1.

Referring now to the drawings, FIGS. 1-3 illustrates an exemplary embodiment of an oven appliance 100 for providing improved heating is shown according to the present disclosure. In particular, FIG. 1 provides a front view of the oven appliance 100 according to the present disclosure. FIG. 2 provides a cross-sectional view of the oven appliance 100 taken along the 2-2 axis shown in FIG. 1. FIG. 3 provides a front cross-sectional view of the oven appliance 100 according to the present disclosure. As shown, the oven appliance 100 includes a cabinet 101 or housing with a cooking chamber 116 positioned therein.

The cabinet 101 extends between a first side 140 (FIG. 1) and a second side 141 (FIG. 1) along a horizontal direction H. Further, the cabinet 101 also extends between a front 142 (FIG. 2) and a back 143 (FIG. 2) along a transverse direction T. The cabinet 101 further extends between a top 144 and a bottom 145 along a vertical direction V. Transverse direction T is substantially perpendicular to horizontal and vertical directions H, V. Thus, vertical direction V, horizontal direction H, and transverse direction T are orthogonally oriented such that vertical direction V, horizontal direction H, and transverse direction T form an orthogonal directional system.

Moreover, as shown in FIGS. 2 and 3, the chamber 101 has interior walls including opposing sidewalls 118, front wall 113, bottom wall 119, back wall 120, and top wall 121 that define cooking chamber 116. Bottom wall 119 and top wall 121 are spaced apart along the vertical direction V, and sidewalls 118 extend along the vertical direction V between top wall 121 and bottom wall 119. Back wall 120 extends between sidewalls 118 along the horizontal direction and also extends between top wall 121 and bottom wall 119 along the vertical direction V.

In certain embodiments, the sidewalls 118 may include supports 122 (FIG. 2) for supporting one or more oven racks 132 (FIG. 2) that may be selectively positioned within chamber 116. Further, as shown in FIGS. 1 and 2, the oven appliance 100 may also include a door 104 with handle 106 that provides for opening and closing access to the chamber 116. As such, a user of the oven appliance 100 can place a variety of different items to be cooked in chamber 116 onto the oven racks 132.

In addition, as shown, heating elements 117 may be positioned at the top and the bottom of chamber 116 to provide heat for cooking and cleaning. More particularly, as shown, the heating elements 117 may include a first heating element 123 arranged adjacent to the bottom wall 119 and a second heating element 125 arranged adjacent to the top wall 121. Furthermore, as shown, one or more the heating elements 117 may include a removable heating element cover 160 arranged adjacent to a respective heating element 117. For example, as shown in the illustrated embodiment, the heating element cover 160 is positioned adjacent to the first heating element 123. Such heating element(s) 117 can be e.g., gas, electric, microwave, or a combination thereof. Other heating elements (not shown) could be located at other locations as well.

A window 110 on door 104 further allows the user to view e.g., food items during the cooking process. Furthermore, as shown, the door 104 may be sealed shut, e.g., via one or more gaskets 170 or seals arranged between the door 104 and the front wall 113 of the oven appliance 100.

Referring particularly to FIG. 1, the oven appliance 100 may further include a user interface panel 102 having a display 103 positioned on a top panel 114 with a variety of controls 112. In certain embodiments, the user interface panel 102 allows the user to select various options for the operation of the oven appliance 100 including e.g., temperature, time, and/or various cooking and cleaning cycles. Accordingly, operation of the oven appliance 100 can be regulated by a controller 124 (FIG. 2) that is operatively coupled i.e., in communication with, user interface panel 102, heating element(s), and other components of oven appliance 100 as will be further described. Moreover, as shown, the oven appliance 100 may also include one or more sensing devices 166, e.g., for detecting a presence of the removable heating element cover 160 within the chamber 116, which is further described herein below.

By way of example, the controller 124 may include a memory and one or more processing devices such as microprocessors, CPUs, or the like, such as general or special purpose microprocessors operable to execute programming instructions or micro-control code associated with operation of the oven appliance 100. The memory may represent random access memory such as DRAM, or read only memory such as ROM or FLASH. In one exemplary embodiment, the processor executes programming instructions stored in memory. The memory may be a separate component from the processor or may be included onboard within the processor.

The controller 124 may be positioned in a variety of locations throughout the oven appliance 100. Thus, the controller 124 may be located under or next to the user interface panel 102 or otherwise within the top panel 114. In an exemplary embodiment, input/output ("I/O") signals are routed between the controller 124 and various operational components of the oven appliance 100 such as heating element(s) 117, controls 112, display 103, sensing device(s), alarms, and/or other components as may be provided. In one exemplary embodiment, the user interface panel 102 may represent a general purpose I/O ("GPIO") device or functional block.

Although shown with touch type controls 112, it should be understood that the controls 112 and the configuration of the oven appliance 100 shown in FIG. 1 is provided by way of example only. More specifically, the user interface panel 102 may include various input components, such as one or more of a variety of electrical, mechanical, or electro-mechanical input devices including rotary dials, push buttons, and touch pads. Further, the user interface panel 102 may include other display components, such as a digital or analog display device designed to provide operational feedback to a user. The user interface panel 102 may be in communication with the controller 124 via one or more signal lines or shared communication busses. Also, the oven appliance 100 is shown as a wall oven but the present invention could also be used with other appliances such as e.g., a stand-alone oven, an oven with a stove-top, and other configurations as well.

In another embodiment, the oven appliance 100 may be equipped with features for selectively generating a forced flow of heated air within the cooking chamber 116 (e.g., using a fan(s) as discussed in greater detail below). Thus, the oven appliance 100 may generally be referred to as a convection oven. Such a flow of heated air can, e.g., decrease the required cooking temperature for food items, decrease the amount of time needed to cook food items, or assist in cooking food items more evenly.

Referring still to FIGS. 2 and 3, the oven appliance 100 may also include a fan cover 154 arranged adjacent to the back wall 120 to at least partially cover a fan assembly 152. Thus, as shown in the illustrated embodiment, the fan cover 154 may also include a plurality of vents or apertures 150 (also referred to herein as a first set of apertures 150) for receiving an airflow therethrough and across the fan assembly 152. For example, as shown, the fan assembly 152 may include a fan blade 153 and a fan motor 155 operably coupled to the fan blade 153 via a motor shaft 157. As such, the motor shaft 157 is configured to rotate the fan blade 153 about a fan axis. Further, as shown, the fan assembly 152 may be positioned adjacent to the back wall 120 of the oven appliance 100. In alternative embodiments, the fan assembly 152 may be located at any suitable location within the oven appliance and any suitable number of fan assemblies may be utilized.

Accordingly, the fan assembly 152 is operable to cause air to flow in the chamber 116. Moreover, the plurality of apertures 150 may have any suitable geometry and/or size. For example, as shown in FIG. 3, the plurality of apertures 150 may be circular. Alternatively, the plurality of apertures 150 may be elongated slots, triangular, oval, or any other suitable shape or combination of shapes.

In addition, as shown in FIGS. 2 and 3, the oven appliance 100 also includes a duct 156 in fluid communication with the fan assembly 152 and the first heating element 123 for directing airflow in the chamber 116 from the fan assembly 152 and across the first heating element 123 to cook a food item 158. For example, as shown particularly in FIGS. 4 and 5, the removable heating element cover 160 at least partially defines the duct 156.

Figure 4:
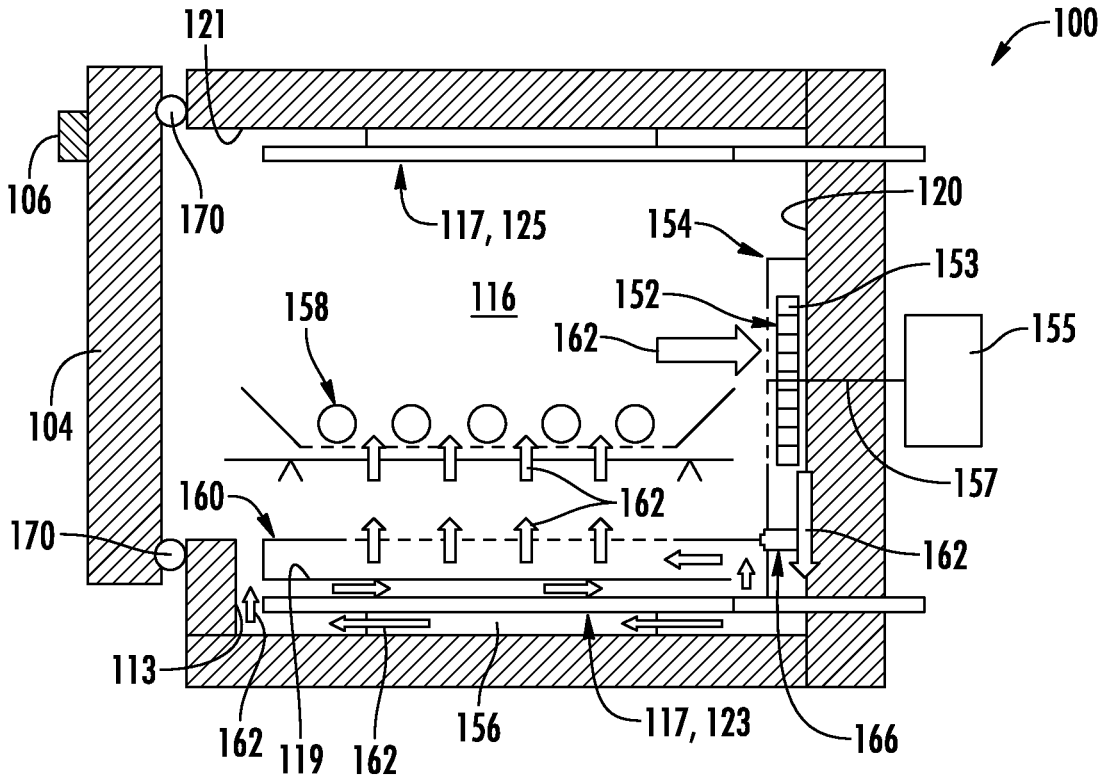
FIG. 4 provides a cross-sectional view of the oven appliance taken along the 2-2 axis of FIG. 1, particularly illustrating the direction of airflow flowing through the oven appliance during an air fry mode.

Accordingly, as shown in FIG. 4, arrows 162 represent the airflow during a cooking process, such as an air fry mode, of the oven appliance 100. Thus, as shown, the duct 156 directs the airflow from the fan assembly 152 across the first heating element 123 and through the bottom wall 119 and the removable heating element cover 160 to heat the food item 158. In particular, as shown in FIG. 4, the removable heating element cover 160 may include a second set of apertures 164 that allows the airflow 162 to pass therethrough. In certain embodiments, the removability of the heating element cover 160 allows for the oven appliance 100 to operate in multiple cooking modes and can also assist with cleaning.

Figure 6:
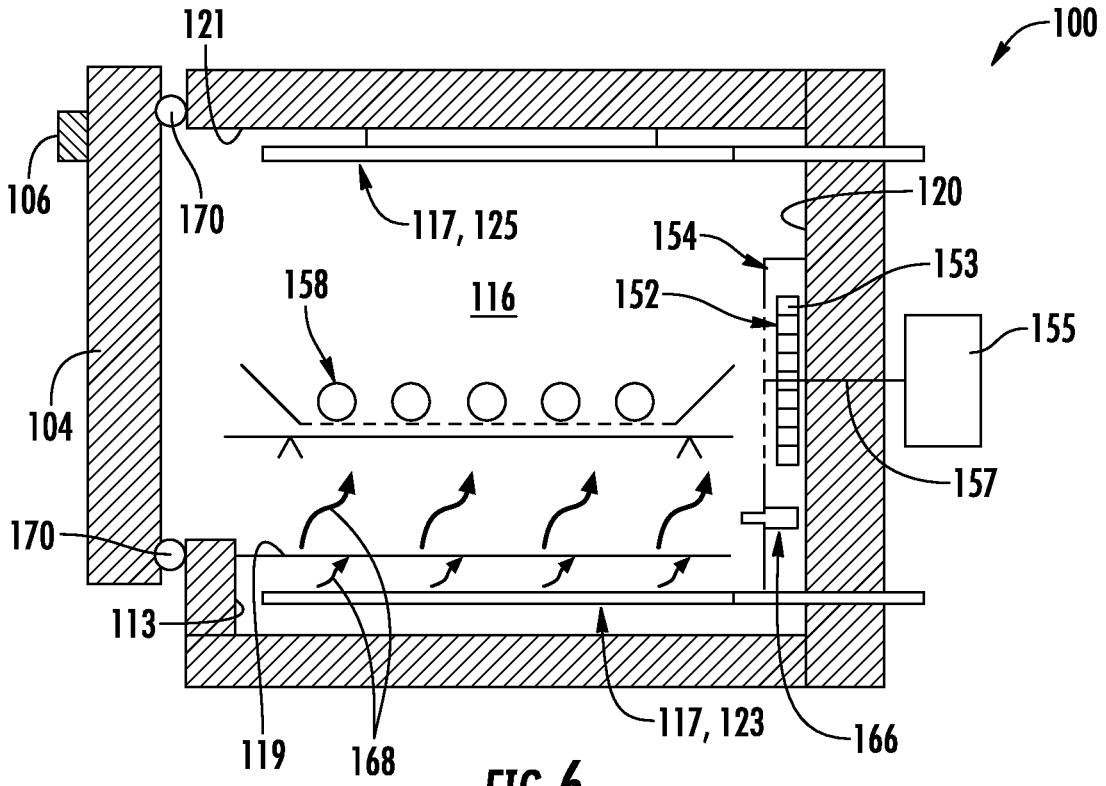
FIG. 6 provides a cross-sectional view of the oven appliance taken along the 2-2 axis of FIG. 1, particularly illustrating the direction of airflow flowing through the oven appliance during a normal operation mode.

Alternatively, as shown in FIG. 6, arrows 168 represent the heat transfer during another cooking process, such as a normal operation mode or bake operation mode, of the oven appliance 100. Thus, in such embodiments, as shown, the removable heating element cover 160 is removed from the oven appliance 100 such that the heat transfer flows upward from the first heating element 123 and through the bottom wall 119 to heat the food item 158.

Figure 5:
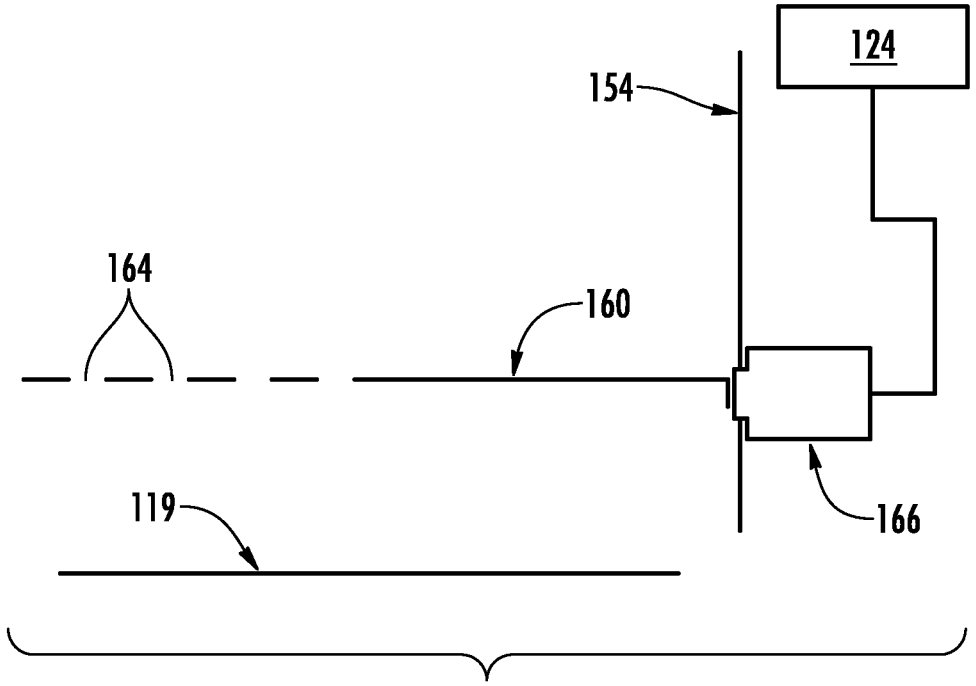
FIG. 5 provides a detailed, side view of the oven appliance of FIG. 4, particularly illustrating the removable heating element cover engaged with the sensing device.
Figure 7:
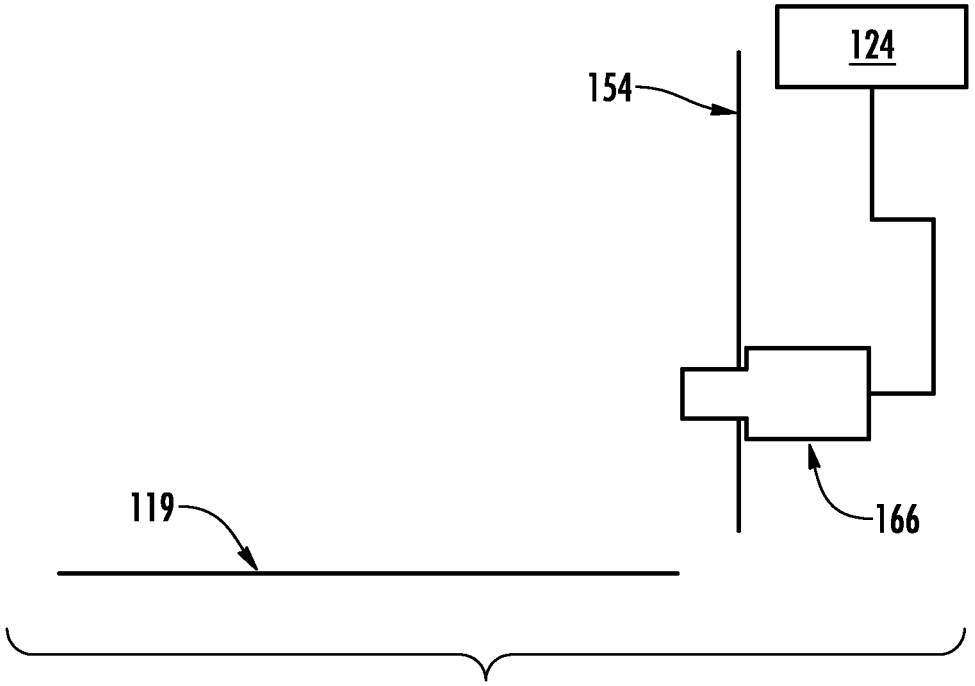
FIG. 7 provides a detailed, side view of the oven appliance of FIG. 6, particularly illustrating the removable heating element cover removed from the oven appliance.

Furthermore, as shown in FIGS. 5 and 7, the sensing device 166 may be communicatively coupled to the controller 124. Thus, the controller 124 is configured to receive an indication from the sensing device 166 confirming whether the removable heating element cover 160 is engaged with the sensing device 166 (FIGS. 4 and 5) or not (FIGS. 6 and 7). Therefore, the controller 124 can control an operation mode of the oven appliance 100 based on the indication.

More particularly, in an embodiment, as shown in FIGS. 4 and 5, the sensing device 166 may be a mechanical switch, such as a push-button switch. In further embodiments, additional types of mechanical switches may also be utilized to communicate the status of the removable heating element cover 160 with the controller 124. Thus, in such embodiments, when the removable heating element cover 160 is present within the chamber 116 and correctly installed against the push-button switch, the sensing device 166 can send an indication of such to the controller 124. In such embodiments, for example, the removable heating element cover 160 is configured to compress the push-button switch when properly installed within the chamber 116.

Furthermore, as shown, the sensing device 166 can be installed at any suitable location so as to engage the removable heating element cover 160. For example, as shown in FIGS. 4 and 5, the sensing device 166 is positioned at least partially through the fan cover 154. In such embodiments, the fan cover 154 is configured to support the sensing device at the appropriate height within the chamber 116, i.e., for engaging the removable heating element cover 160. In further embodiments, the sensing device 166 may be arranged at any other suitable location and in any suitable orientation, such as vertically, horizontally, or at an angle.

Figure 8:
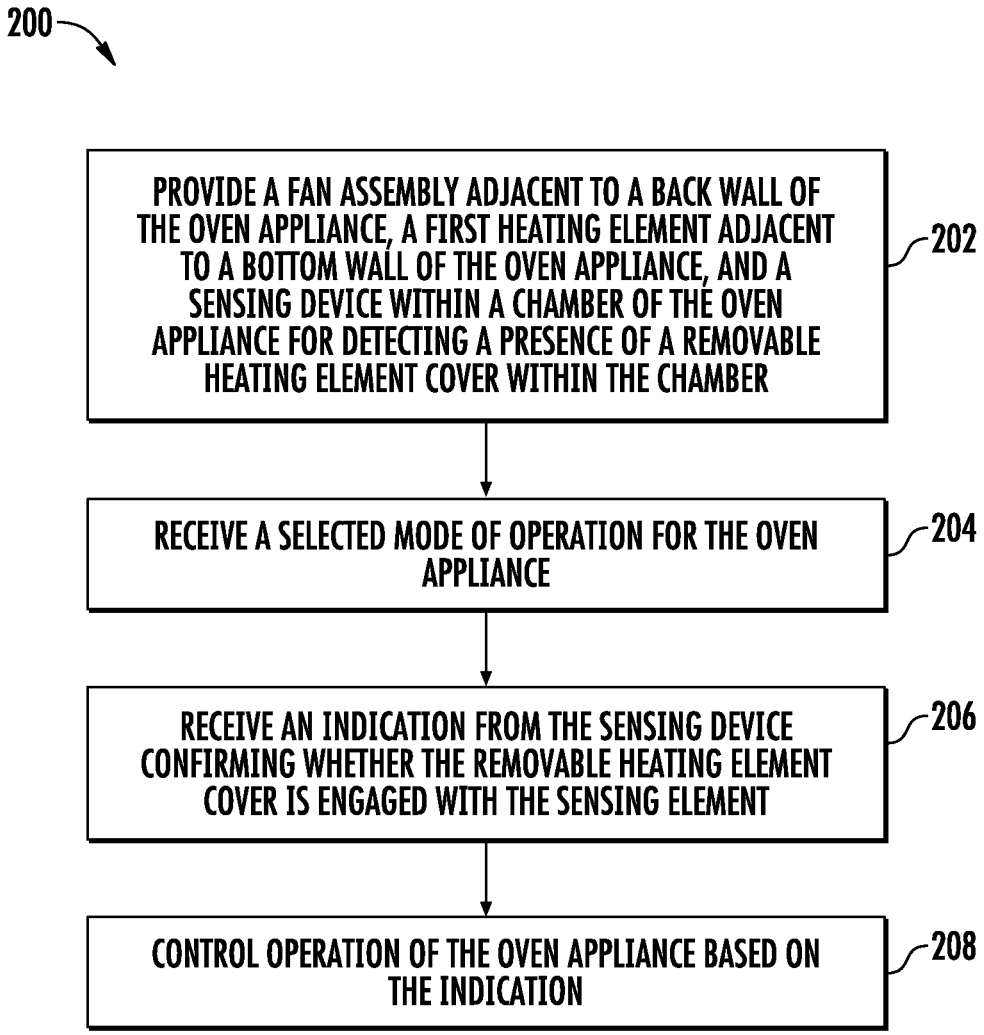
FIG. 8 provides a flow diagram of one embodiment of a method of operating an oven appliance according to the present disclosure.

Referring now to FIG. 8, a flow diagram of one embodiment of a method 200 for operating an oven appliance, such as oven appliance 100, is illustrated. In general, the method 200 will be described herein with reference to the oven appliance 100 described above with reference to FIGS. 1-7. However, it should be appreciated by those of ordinary skill in the art that the disclosed method 200 may generally be utilized to operate any other oven appliance having any suitable configuration. In addition, although FIG. 8 depicts steps performed in a particular order for purposes of illustration and discussion, the methods discussed herein are not limited to any particular order or arrangement. One skilled in the art, using the disclosures provided herein, will appreciate that various steps of the methods disclosed herein can be omitted, rearranged, combined, and/or adapted in various ways without deviating from the scope of the present disclosure.

As shown at (202), the method 200 includes providing the fan assembly 152 adjacent to the back wall 120 of the oven appliance 100, the first heating element 123 adjacent to the bottom wall 119 of the oven appliance 100 and the sensing device 166 within the chamber 116 of the oven appliance 100. Thus, the sensing device 166 is configured for detecting a presence of the removable heating element cover 160 within the chamber 116. As shown at (204), the method 200 includes receiving a selected mode of operation for the oven appliance 100. For example, in an embodiment, the selected mode of operation may include an air fry mode, a normal operation mode (such as a bake mode), or another other suitable operational mode of the oven appliance 100.

As shown at (206), the method 200 includes receiving an indication from the sensing device 166 confirming whether the removable heating element cover 160 is engaged with the sensing device 166. As shown at (208), the method 200 includes controlling operation of the oven appliance 100 based on the indication. More specifically, in an embodiment, controlling operation of the oven appliance 100 based on the indication may include initiating or preventing initiating of the selected mode of operation based on the indication.

Figure 9:
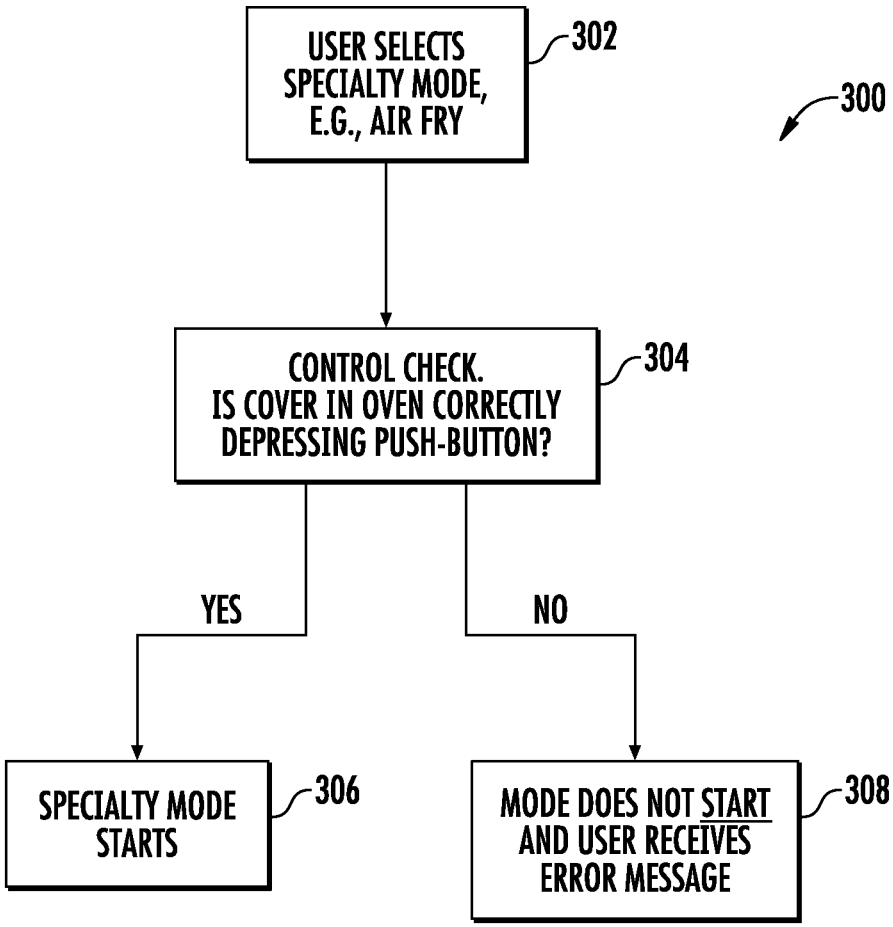
FIG. 9 provides a flow diagram of one embodiment of a method of operating an oven appliance in an air fry mode according to the present disclosure.

For example, as shown in FIG. 9, a flow diagram of a method 300 of one embodiment of operating the oven appliance 100 is illustrated. As shown at (302), a user selects the air fry mode, e.g., using the user interface 102. Upon such selection, as shown at (304), the method 300 may include checking to ensure the removable heating element cover 160 is correctly engaging the sensing device 166 (e.g., as shown in FIGS. 4 and 5). If yes, as shown at (306), the method 300 further includes initiating the air fry mode, e.g., when the indication from the sensing device 166 confirms that the removable heating element cover 160 is present in the chamber 116. As described herein, the air fry mode may include heating the chamber 116 via first and second heating elements 123, 125 and operating the fan assembly 152 to direct airflow in the chamber 116 across a top surface of the food item 158 adjacent to the second heating element 125 to heat a top surface of the food item 158 and into the duct 156. Further, the duct 156 is in fluid communication with the fan assembly 152 and the first heating element 123 so as to further draw the airflow across the first heating element 123 to heat a bottom surface of the food item 158. More particularly, as shown in FIG. 4, during operation of the oven appliance in the air fry mode, the airflow in the chamber is drawn in through the first set of apertures 150 in the fan cover 154, down to and across the first heating element 123, up through the bottom wall 191 and through the second set of apertures 164 of the removable heating element cover 160. Such operation, for example, is configured to cook food items to a desired crispy texture.

Alternatively, as shown at (308), the method 300 includes preventing initiating of the air fry mode when the indication from the sensing device 166 confirms that the removable heating element cover 160 is not engaged with the sensing device (e.g., the removable heating element cover 160 has been removed from the chamber 116 or is not properly installed). In addition, as shown at (308), in such embodiments, the method 300 may also include generating an error message. As such, a user is notified that the air fry mode cannot be initiated until the removable heating element cover 160 is properly installed.

Figure 10:
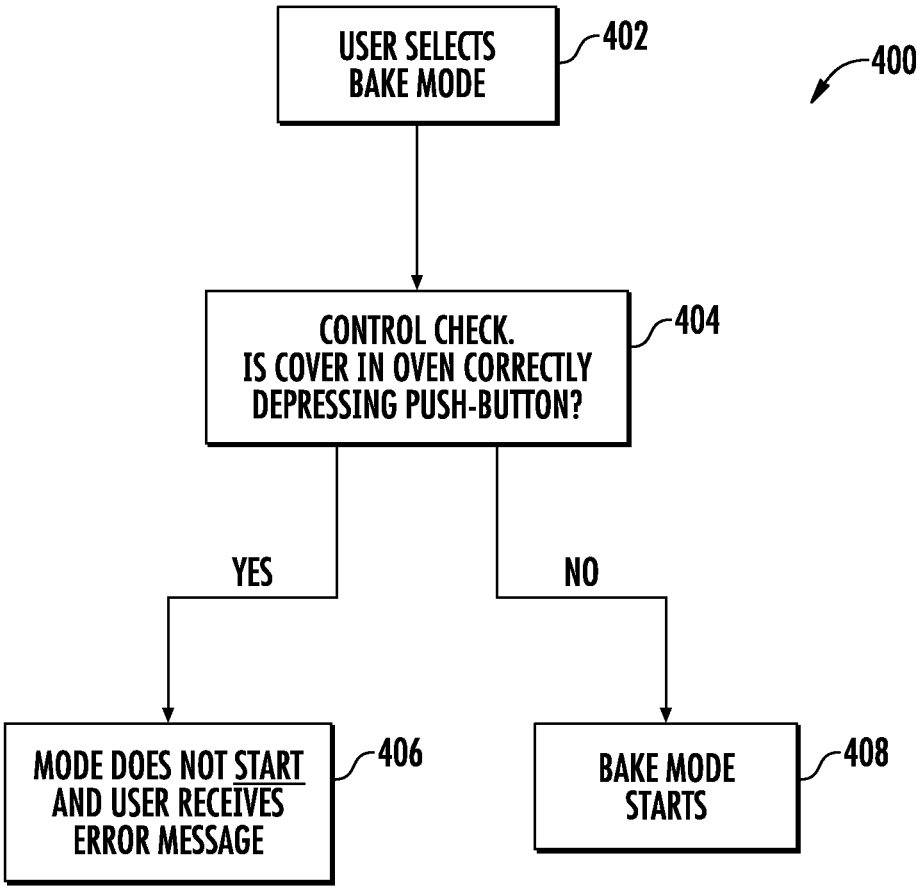
FIG. 10 provides a flow diagram of one embodiment of a method of operating an oven appliance in a normal operation mode according to the present disclosure.

Referring now to FIG. 10, a flow diagram of a method 400 of one embodiment of operating the oven appliance 100 is illustrated. As shown at (402), a user selects a normal operation mode (e.g., a bake mode) using the user interface 102. Upon such selection, as shown at (404), the method 400 may include checking whether the removable heating element cover 160 is engaging the sensing device 166. If yes, as shown at (406), the method 400 includes preventing initiating of the normal operation mode as the removable heating element cover 160 is not used during the normal operation mode. In addition, as shown at (406), in such embodiments, the method 300 may also include generating an error message. As such, a user is notified that the normal operation mode cannot be initiated until the removable heating element cover 160 is removed from the chamber 116. Alternatively, as shown at (408), if the removable heating element cover 160 is not detected, the method 400 includes initiating the normal operation mode.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven appliance, comprising:

a cabinet having a chamber positioned within the cabinet, the chamber configured for receipt of a food item for cooking;

a door for providing selective access to the chamber;

a plurality of walls comprising a top wall, a bottom wall, a back wall, a front wall, and opposing sidewalls defining the chamber;

a fan assembly operable to cause air to flow in the chamber;

a first heating element arranged adjacent to the bottom wall;

a removable heating element cover configured for defining a duct in fluid communication with the fan assembly and the first heating element for directing airflow in the chamber to the fan assembly and across the first heating element to heat the food item;

a sensing device for detecting a presence of the removable heating element cover within the chamber, wherein the sensing device comprises a mechanical switch; and a controller communicatively coupled to the sensing device, the controller comprising at least one processor, the at least one processor configured to perform a plurality of operations, the plurality of operations comprising:

receiving an indication from the sensing device confirming whether the removable heating element cover is engaged with the sensing device, wherein, when the removable heating element cover is present within the chamber, the removable heating element cover engages the mechanical switch; and controlling operation of the oven appliance based on the indication.

2. The oven appliance of claim 1, wherein the plurality of operations further comprise receiving a selected mode of operation for the oven appliance, wherein controlling operation of the oven appliance based on the indication further comprises initiating or preventing initiating of the selected mode of operation based on the indication.

3. The oven appliance of claim 2, wherein the selected mode of operation comprises at least one of an air fry mode or a normal operation mode.

4. The oven appliance of claim 3, wherein, when the selected mode of operation is the air fry mode, initiating or preventing initiating of the selected mode of operation based on the indication further comprises initiating the air fry mode when the indication from the sensing device confirms that the removable heating element cover is engaged with the sensing device or preventing initiating of the air fry mode when the indication from the sensing device confirms that the removable heating element cover is not engaged with the sensing device.

5. The oven appliance of claim 4, wherein, during operation of the oven appliance in the air fry mode, the airflow in the chamber is drawn in through a first set of apertures in the fan cover, down to and across the first heating element, up through the bottom wall and through a second set of apertures of the removable heating element cover.

6. The oven appliance of claim 3, wherein, when the selected mode of operation is the normal operation mode, initiating or preventing initiating of the selected mode of operation based on the indication further comprises initiating the normal operation mode when the indication from the sensing device confirms that the removable heating element cover is not engaged with the sensing device or preventing initiating of the normal operation mode when the indication from the sensing device confirms that the removable heating element cover is engaged with the sensing device.

7. The oven appliance of claim 2, wherein the plurality of operations further comprise generating an error message upon preventing initiating of the selected mode of operation.

8. The oven appliance of claim 1, wherein the mechanical switch is a push-button switch, wherein, when the removable heating element cover is present within the chamber, the removable heating element cover compresses the push-button switch.

9. The oven appliance of claim 8, wherein receiving the indication from the sensing device confirming whether the removable heating element cover is engaged with the sensing device further comprises receiving the indication from the sensing device that the push-button switch is compressed.

10. The oven appliance of claim 1, further comprising a fan cover arranged to at least partially cover the fan assembly, wherein the sensing device is positioned at least partially through the fan cover.

11. The oven appliance of claim 1, wherein the fan assembly comprises a fan blade and a fan motor, the fan motor comprising, at least, a motor shaft operably coupled to the fan blade for rotating the fan blade about the motor shaft, and wherein the fan assembly is positioned adjacent to the back wall.

12. The oven appliance of claim 1, further comprising a second heating element arranged adjacent to the top wall.

13. A method for operating an oven appliance, the method comprising:

providing a fan assembly adjacent to a back wall of the oven appliance;

providing a first heating element adjacent to a bottom wall of the oven appliance;

providing a sensing device within a chamber of the oven appliance for detecting a presence of a removable heating element cover within the chamber, the removable heating element cover configured for defining a duct in fluid communication with the fan assembly and the first heating element for directing airflow in the chamber to the fan assembly and across the first heating element to heat a food item in the chamber;

receiving an indication from the sensing device confirming whether the removable heating element cover is engaged with the sensing device;

receiving a selected mode of operation for the oven appliance; and controlling operation of the oven appliance based on the indication, wherein controlling operation of the oven appliance based on the indication further comprises initiating or preventing initiating of the selected mode of operation based on the indication, wherein the selected mode of operation comprises at least one of an air fry mode or a normal operation mode.

14. The method of claim 13, wherein, when the selected mode of operation is the air fry mode, initiating or preventing initiating of the selected mode of operation based on the indication further comprises initiating the air fry mode when the indication from the sensing device confirms that the removable heating element cover is engaged with the sensing device or preventing initiating of the air fry mode when the indication from the sensing device confirms that the removable heating element cover is not engaged with the sensing device.

15. The method of claim 14, wherein the air fry mode further comprises:

heating the chamber via first and second heating elements arranged adjacent to the bottom wall and a top wall of the oven appliance, respectively; and operating the fan assembly of the oven appliance to direct airflow in the chamber across a top surface of the food item adjacent to the second heating element to heat a top surface of the food item and into a duct, wherein the duct is in fluid communication with the fan assembly and the first heating element so as to further draw the airflow across the first heating element to heat a bottom surface of the food item.

16. The method of claim 13, wherein, wherein, when the selected mode of operation is the normal operation mode, initiating or preventing initiating of the selected mode of operation based on the indication further comprises initiating the normal operation mode when the indication from the sensing device confirms that the removable heating element cover is not engaged with the sensing device or preventing initiating of the normal operation mode when the indication from the sensing device confirms that the removable heating element cover is engaged with the sensing device.

17. The method of claim 13, further comprising generating an error message upon preventing initiating of the selected mode of operation.

* * * * *